US007810173B1

(12) United States Patent
Lambeth

(10) Patent No.: US 7,810,173 B1
(45) Date of Patent: Oct. 12, 2010

(54) MALE FERTILITY PROTECTING SHOWER GARMENT

(75) Inventor: Todd McAuley Lambeth, P.O. Box 577052, Modesto, CA (US) 95357

(73) Assignee: Todd McAuley Lambeth, Modesto, CA (US)

( * ) Notice: Subject to any disclaimer, the term of this patent is extended or adjusted under 35 U.S.C. 154(b) by 0 days.

(21) Appl. No.: 12/008,167

(22) Filed: Jan. 8, 2008

(51) Int. Cl.
*A41B 9/02* (2006.01)
*A41B 9/00* (2006.01)

(52) U.S. Cl. ..... 2/403; 2/400

(58) Field of Classification Search ..... 2/400–405; 602/67–72

See application file for complete search history.

(56) References Cited

U.S. PATENT DOCUMENTS 1,421,077 A * 6/1922 Goldsmith ..... 602/71
1,477,187 A * 12/1923 Rayne ..... 602/71
3,229,692 A * 1/1966 Creed ..... 602/72
3,314,422 A * 4/1967 Phillips ..... 128/846
3,621,846 A 11/1971 Lehman
4,453,541 A * 6/1984 Castelli et al. ..... 602/72
4,679,554 A * 7/1987 Markham ..... 602/70
4,922,899 A * 5/1990 Graff et al. ..... 602/72
4,989,594 A * 2/1991 Doherty et al. ..... 602/72
5,003,972 A * 4/1991 Kestler ..... 602/70
5,237,706 A * 8/1993 Nalbandian ..... 2/403
5,479,942 A * 1/1996 DiMatteo ..... 602/67
7,004,921 B2 * 2/2006 Littell ..... 602/67
7,024,703 B1 4/2006 Ratta

* cited by examiner

*Primary Examiner*—Gloria Hale

(57) ABSTRACT

This is a two piece garment used in a shower that provides a barrier between male genitalia and hot water, which protects male fertility. The testes will stay cooler by using the garment. This will protect the viability of the user's semen. One piece is a solid, rigid, water impermeable cup that fits around the male genitalia that is open on the end and oriented downward. It is held over the groin area with a supporter made from stretchable, water tolerable material. A unique feature of the cup is the open bottom. This opening allows water to drain that may enter, and allows air to circulate around the testicles, both help to maintain a cooler environment. The cup is held in place by the supporter that fits around the legs and waist. The supporter is intended to only be used to hold the cup in place against the body.

2 Claims, 4 Drawing Sheets

MALE FERTILITY PROTECTING SHOWER GARMENT

CROSS-REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

1. Field of the Invention

This invention relates to a type of garment, irrespective of style, that is adapted to thermally isolate the genitalia of a male from immediate contact with hot water while taking a shower. It is well-known, in the field of medicine, that a male's semen is heat-sensitive, and high temperature is deleterious to the production of healthy, mobile, and viable sperm.

2. Discussion of Relevant Art

The inventor intends to provide the field of fertility therapy with a garment that in design and function achieves fertility protection. While nature provides the scrotum the ability to hold the testicles sufficiently away from the body, so as to maintain a thermal environment conductive to sperm viability, such protection is negated by hot water coming in contact with the testicles.

BRIEF SUMMARY OF THE INVENTION

The primary object of the invention is to provide a male with a waterproof, and water deflecting garment that prevents hot water from a shower from coming in contact with his testicles, while also allowing the testicles to be exposed to the air outside the garment. The garment consists of two items. One is the unique cup that is water proof and water deflecting, and the other is a unique water tolerable supporter that is designed for the cup and holds the cup in place.

One object of the garment is that the shape of the cup follows the typical outline of a male organ at rest. The cup is open on the side that is in contact with the groin area and completely covers the male organ. The cup is securely held against the groin area by the specialized supporter. This achieves the desired outcome of preventing hot water from coming in contact with the male testicles.

Another object of the garment is that the cup is open on the end that points downward; this allows any water that may enter the cup to flow away from the testicles, and also allows air to circulate around the male genitals.

Another object of the garment is that it is held securely in place by a specialized, water tolerable, supporter that fits around the male legs and waist. The supporter holds the cup in place by encircling the lower portion of the cup, and by partially covering the outer surface of the cup.

Another object of the garment is that the cup portion of the invention is removable and separate from the supporter.

Another object of the garment is that the cup is made from a rigid, water proof material.

Another object of the garment is that the supporter is made from a water tolerable stretchable material. The supporter is made in different sizes to accommodate the user.

Other objectives and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an invention for preventing water from coming in contact with the male genitals while taking a shower. The invention is comprised of: A rigid, waterproof, and water deflecting cup that fits securely against the male groin, encircling, and covering the male organ. The cup is open on the end that points downward. The invention is also comprised of a unique, water tolerable, supporter made with stretchable material that is available in different sizes that is designed for the cup, and is used to hold the cup securely in place against the groin of the male.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The figures and descriptions show a support garment having a stretchable waistband to encircle the waist of a wearer that holds in place a solid, rigid, water impermeable cup structure that covers the male genitalia that prevents water from coming in contact with the male genitals.

Figure 1:
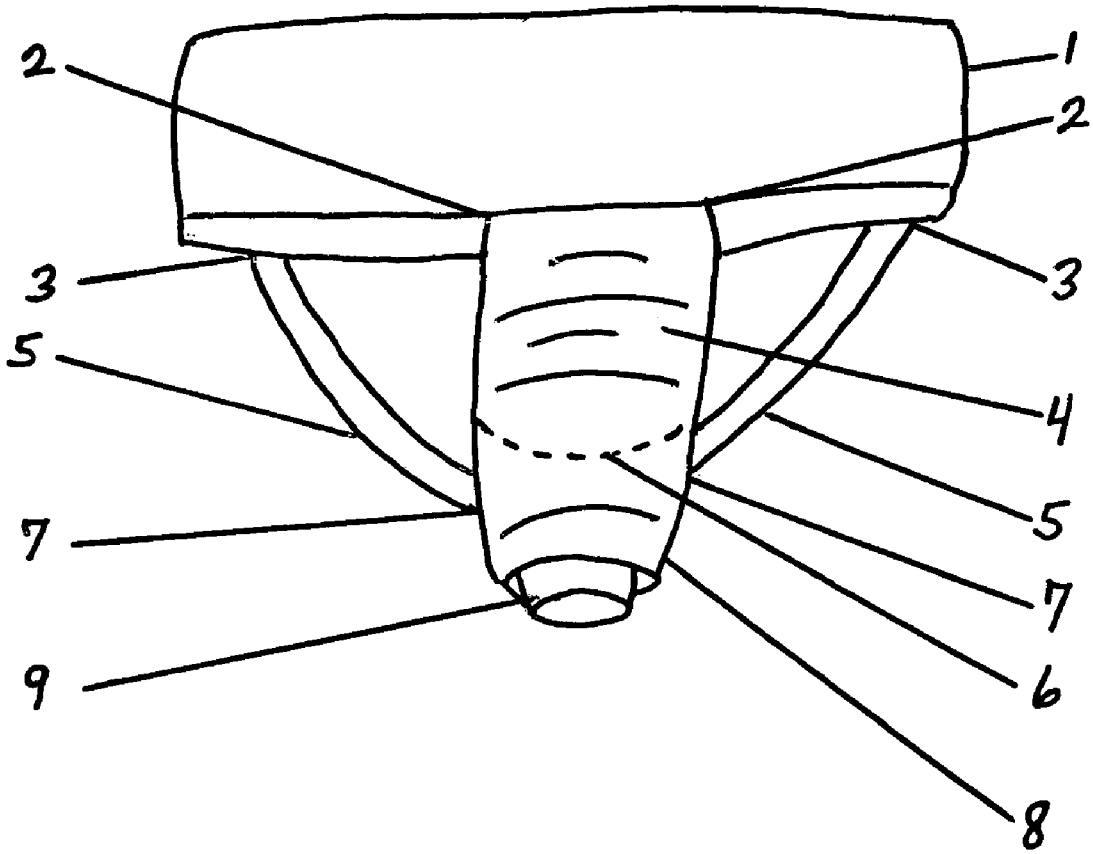
FIG. 1 is a front, plan view of the support garment with the solid, rigid, water impermeable cup structure inside the garment.

FIG. 1 is a front, plan view of the invention. It shows a support garment made with stretchable material, with a stretchable waistband (1) holding the solid, rigid, water impermeable cup structure (9). The top of the front panel portion (4) is connected to the waistband by stitching (2). The front panel portion has a bottom edge that is attached to a tubular open ended bottom end portion (8). The bottom end portion encircles the lower portion of the solid, rigid, water impermeable cup structure (9). The solid, rigid, water impermeable cup structure can be seen extending from the bottom of the tubular end portion of the front panel portion of the support garment. The concave dash line (6) represents the top edge of the tubular open ended portion on the bottom area of the front panel portion of the garment. The two angled lines represent left and right leg bands (5) that are attached by stitching (7) to a rear side of the tubular bottom end portion of the front garment, and by stitching (3) to a rear bottom portion of the waist band. The leg bands are made in different sizes to accommodate the user. The waist band is manufactured in different sized to accommodate the user.

Figure 2:
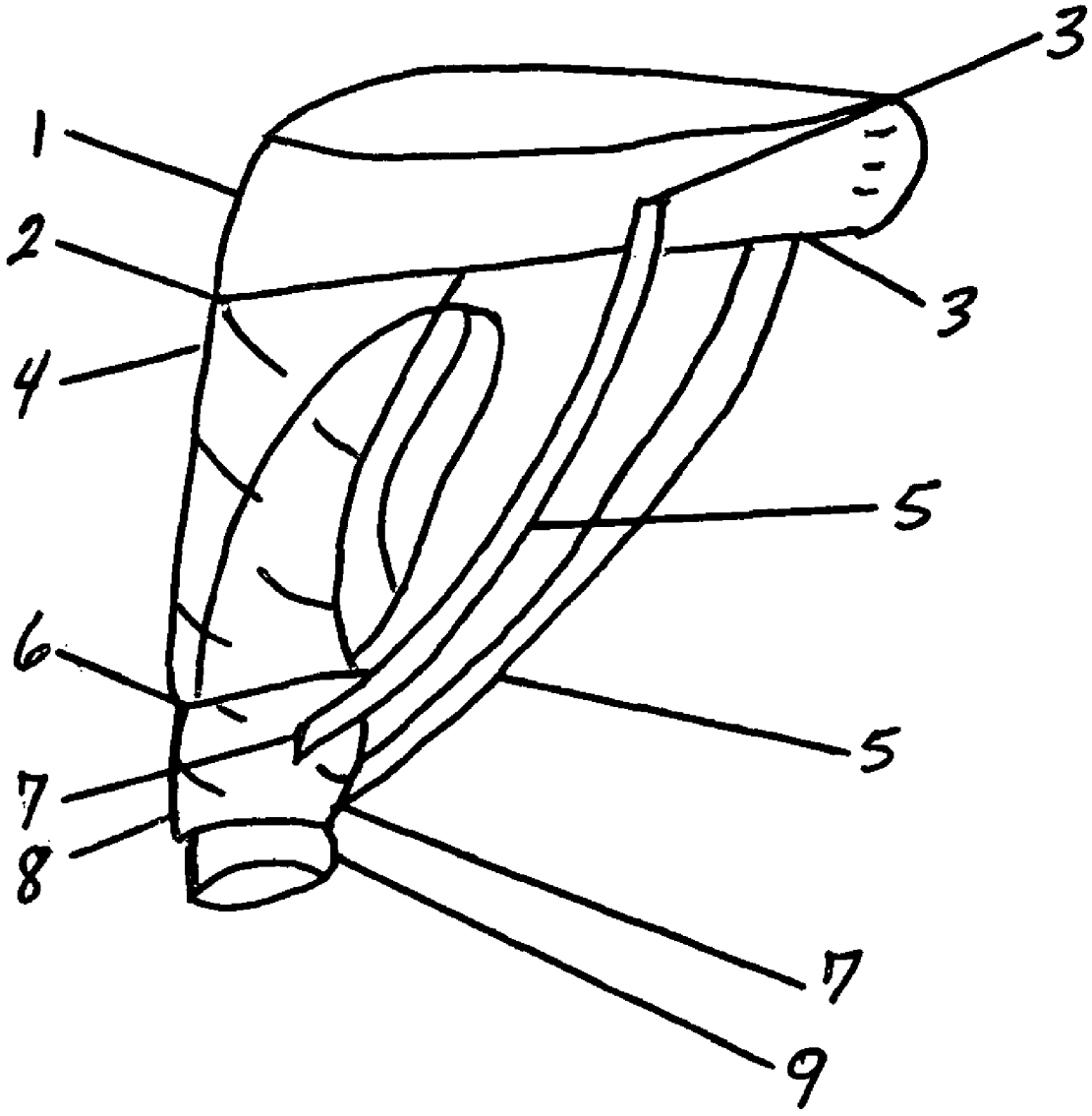
FIG. 2 is a side, cross sectional view of the garment with the solid, rigid, water impermeable cup structure inside the garment

FIG. 2 is a side, cross sectional view of the invention. It shows how the solid, rigid, water impermeable cup structure (9) is held in place by the tubular bottom end portion of the front panel portion of the support garment. The tubular bottom end encircles the lower area of the cup (8). The front panel portion of the support garment (4) partially covers the front of the solid, rigid, water impermeable cup structure, and is made from a stretchable material. The left and right leg bands (5) are attached by stitching (7) to the lower rear side of the tubular bottom and by stitching (3) to the rear of the waist band.

Figure 3:
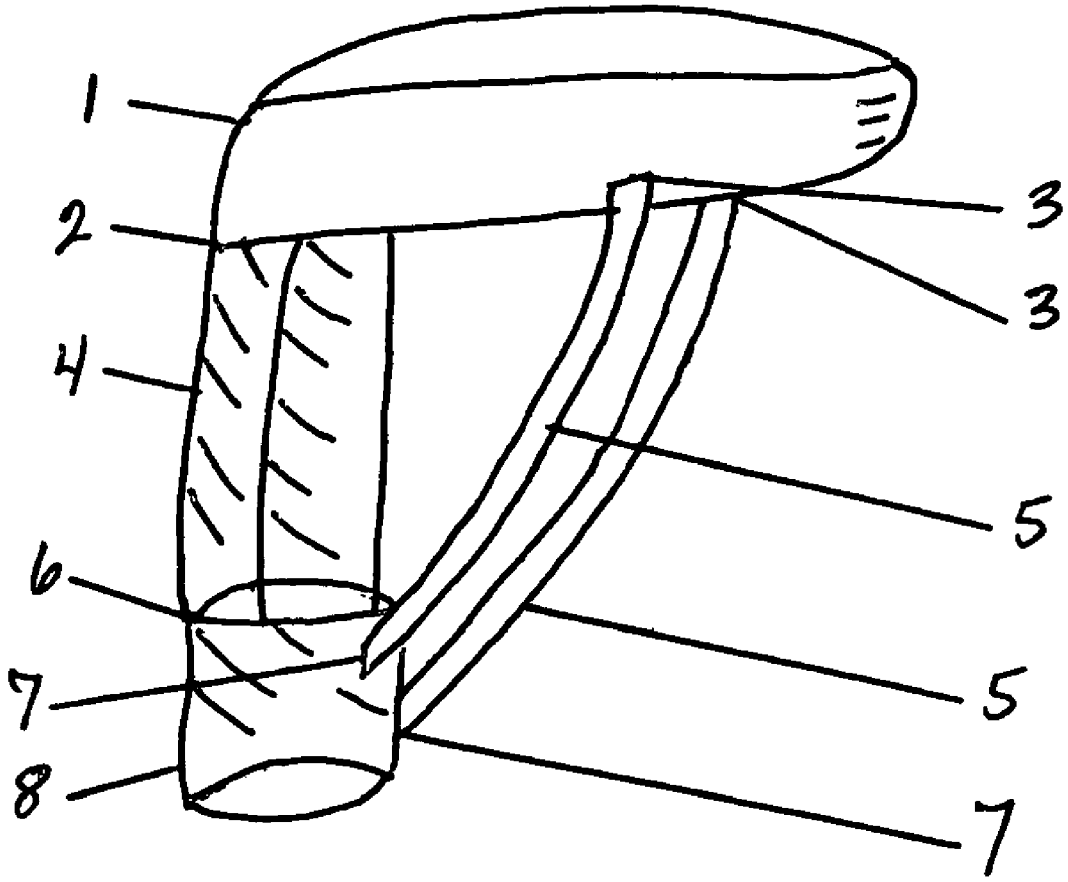
FIG. 3 is a side, cross sectional view of the garment without the solid, rigid, water impermeable cup structure

FIG. 3 is a side, cross sectional view of the support garment without the solid, rigid, water impermeable cup structure inserted. The reference numbers on FIG. 3 correspond to previously explained items.

Figure 4:
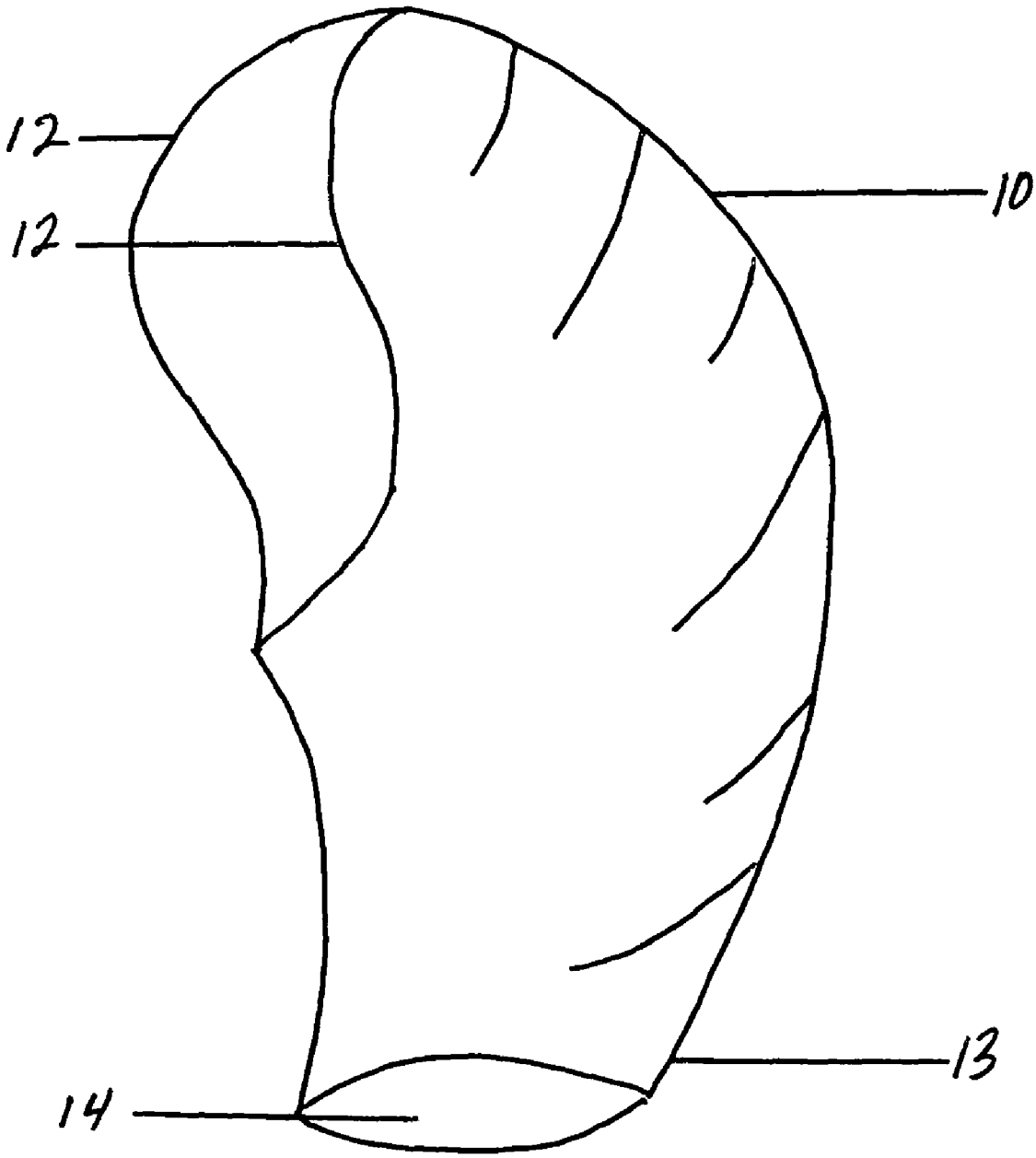
FIG. 4 is a side, plan view of the solid, rigid, water impermeable cup structure

FIG. 4 is a side, plan view of the solid, rigid, water impermeable cup structure removed from the support garment. It is comprised of a U-shaped outwardly curved open top edge (10) and a U-shaped outwardly curved open bottom edge (13). The edges on the top opening (12) lie directly on and touch the skin of the wearer's groin. The U-shaped outwardly curved bottom edge (13) is depicted. The outwardly curved top and bottom edges of the cup provide a flow through tunnel passage (14).

The garment is composed of two pieces. One piece is a solid, rigid, water impermeable cup structure that has a lower tubular portion and a curved side profile that curves inwardly towards the wearer and has an open upper end wherein the tubular opening extends toward the wearer. The solid, rigid, water impermeable cup structure is designed to fit around the male organ while being held securely to the groin area with a support garment having a stretchable waistband. The shape of the solid, rigid, water impermeable cup structure deflects water away from the male organ. The solid, rigid, water impermeable cup structure is open on the bottom, this allows any water that may enter the solid, rigid, water impermeable cup structure to drain, and allows air to circulate inside the solid, rigid, water impermeable cup structure.

The support garment having a stretchable waistband is made from a stretchable, water tolerable material that holds the solid, rigid, water impermeable cup structure securely in contact with the groin area of the male body. The support garment fits around the legs and waist, and is made in various sizes.

This device will prevent hot water from coming in continuous contact with the male's genitals by deflecting it away while he is taking a shower.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A male genitalia shower protection garment for protecting the male genitalia, primarily the testicles, from the direct contact of the flow and splashing of water from a shower nozzle and spray, comprising:

a support garment having a stretchable waistband to encircle the waist of a wearer;

a front panel portion having a top end connected to the waistband by stitching and extending downwardly there from and of a length to cover the genitalia of the wearer;

the front panel portion having a bottom edge that is attached to a tubular open ended bottom end portion;

the tubular bottom end portion of the front panel portion has a circular outwardly curving open bottom edge;

left and right leg bands have one end attached by stitching to a rear side of the tubular bottom end portion and a second end attached by stitching to a rear of the waistband;

a solid, rigid, water impermeable cup structured to cover the male genitalia is inserted within the tubular bottom end portion and frictionally held therein;

the cup forms a shell about the male genitalia and has a U-shaped outwardly curved open top edge and a U-shaped outwardly curved open bottom edge connected by left and right side edges that lie directly on and touch the skin of the wearer's groin and are formed to follow the angle of the wearer's groin to thereby provide a sealing of the cup along the wearer's groin to thereby prevent water from flowing between the cup and the body of the wearer;

the outwardly curved top and bottom edges of the cup thereby providing a flow through tunnel passage so that air circulates about the genitalia of the wearer and so that shower water passes through and flows downward and away from the wearer's genitalia while the curved frontal profile of the cup will prevent the direct contact of the shower spray from hitting against the genitalia of the wearer; and, wherein the tubular bottom end portion of the front portion of the garment frictionally holds the rigid cup therein and securely on the genitalia of the wearer.

2. A male genitalia shower protection garment for protecting the male genitalia, primarily the testicles, from the direct contact of the flow and splashing of water from a shower nozzle and spray as claimed in claim 1 and further, comprising:

wherein said solid, rigid, water impermeable cup has a lower tubular portion and a curved side profile that curves inwardly towards the wearer and has an open upper end wherein the tubular opening extends toward the wearer.

* * * * *